US007445459B2

(12) United States Patent
Hsiao et al.

(10) Patent No.: US 7,445,459 B2
(45) Date of Patent: Nov. 4, 2008

(54) ELECTRICAL CONNECTOR WITH MOVABLE CONTACT

(75) Inventors: Shih-Wei Hsiao, Tu-Cheng (TW); Ming-Yue Chen, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/810,250

(22) Filed: Jun. 5, 2007

(65) Prior Publication Data

US 2007/0281515 A1 Dec. 6, 2007

(30) Foreign Application Priority Data

Jun. 5, 2006 (TW) ..... 95209741 U

(51) Int. Cl.
*H01R 12/00* (2006.01)

(52) U.S. Cl. ..... 439/66; 439/74

(58) Field of Classification Search ..... 439/66, 439/74, 83, 824; 324/754, 755
See application file for complete search history.

(56) References Cited

U.S. PATENT DOCUMENTS 5,877,554 A * 3/1999 Murphy ..... 257/727
6,046,597 A * 4/2000 Barabi ..... 324/755
6,464,511 B1 * 10/2002 Watanabe et al. ..... 439/66
6,902,410 B2 * 6/2005 Watanabe ..... 439/66
7,025,602 B1 * 4/2006 Hwang ..... 439/66
7,226,296 B2 * 6/2006 Ngo ..... 439/71
7,214,069 B2 * 5/2007 Rathburn ..... 439/66

* cited by examiner

*Primary Examiner*—Thanh-Tam T Le
(74) *Attorney, Agent, or Firm*—Wei Te Chung

(57) ABSTRACT

An electrical connector includes an insulative housing (2) having an exterior side (23) adapted to face a substrate, a substantially elongated terminal (1), and a body of reflowable, electrically conductive material (5). The terminal is adapted to mate with a mating component and extends substantially to the exterior side of the insulative housing. The terminal includes a movable contact end (12) longitudinally movable relative to the insulative housing. The body of reflowable, electrically conductive material is disposed on the movable contact end adjacent the exterior side of the insulative housing. As such, since the electrical connector is assembled onto the substrate by the formation of the body of conductive material between terminals of the electrical connector and the substrate, no openings or holes have been defined on the substrate, thereby doing no damage to a wiring or connection layout on the substrate.

2 Claims, 6 Drawing Sheets

ELECTRICAL CONNECTOR WITH MOVABLE CONTACT

BACKGROUND OF THE INVENTION

1. Field of the Invention

The present invention relates to the art of electrical connectors, and more particularly to an electrical connector having a movable contact adapted for connection to a substrate.

2. Description of the Related Art

FIG. 5 shows one conventional electrical connector assembly including a substrate 3' and an electrical connector assembled onto the substrate 3'. The electrical connector includes an insulative housing 2' defining a mating side 21' adapted to face a mating component (not shown), such as an LGA package, and a mounting side 23' adapted to face the substrate 3, an opening 25' extending from the mating side 21' towards the mounting side 23', and a movable contact 1' insertable into the opening 25' of the insulative housing 2' and defining a movable contact end 12' longitudinally movable relative to the insulative housing 2'. The assembly of the electrical connector onto the substrate 3' is achieved by pressing the movable contact end 12' against a mounting surface of the substrate 3'. In order to balance the force resulting from the pressing action of the movable contact end 12', fastening means, such as a plurality of pins 4', is needed to extend through the substrate 3', i.e., openings 31' formed on the substrate, to establish a mechanical connection between the electrical connector and the substrate 3'. The formation of the openings 31' on the substrate 3' will take up a "real estate" of the substrate 3', where much more active and passive elements are needed to be equipped thereon. FIG. 6 shows another way of assembling an electrical connector onto the substrate 3' by movable contact ends 12' of terminals 1' extending into through holes 31' defined on the substrate 3' so as to form a mechanical connection between the electrical connector and the substrate 3'. In deed, the through holes 31' of the substrate 3' may take up a "real estate" of the substrate 3', and sometimes will do damage to a connection layout on the substrate 3'. Therefore, there is a need to provide an electrical connector to resolve the above-mentioned shortcomings.

SUMMARY OF THE INVENTION

An electrical connector according to an embodiment of the present invention includes an insulative housing having an exterior side adapted to face a substrate, a substantially elongated terminal, and a body of reflowable, electrically conductive material. The terminal is adapted to mate with a mating component and extends substantially to the exterior side of the insulative housing. The terminal includes a movable contact end longitudinally movable relative to the insulative housing. The body of reflowable, electrically conductive material is disposed on the movable contact end adjacent the exterior side of the insulative housing. As such, since the electrical connector is assembled onto the substrate by the formation of the body of conductive material between terminals of the electrical connector and the substrate, no openings or holes have been defined on the substrate, thereby doing no damage to a wiring or connection layout on the substrate.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
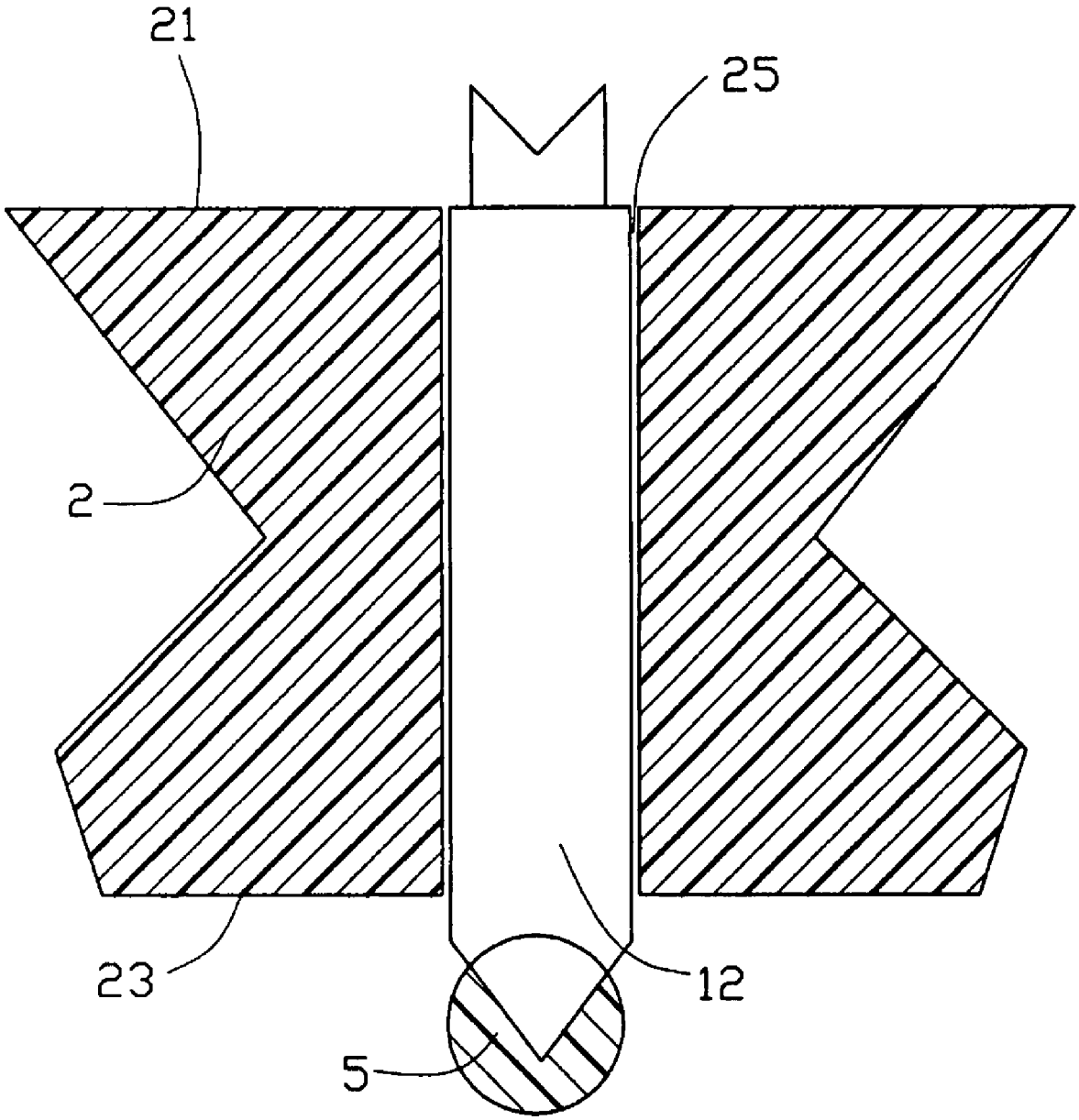
FIG. 1 is a sketch view of a part of an electrical connector according to a first embodiment of the present invention, showing a distal end of a terminal residing within a body of conductive material.
Figure 2:
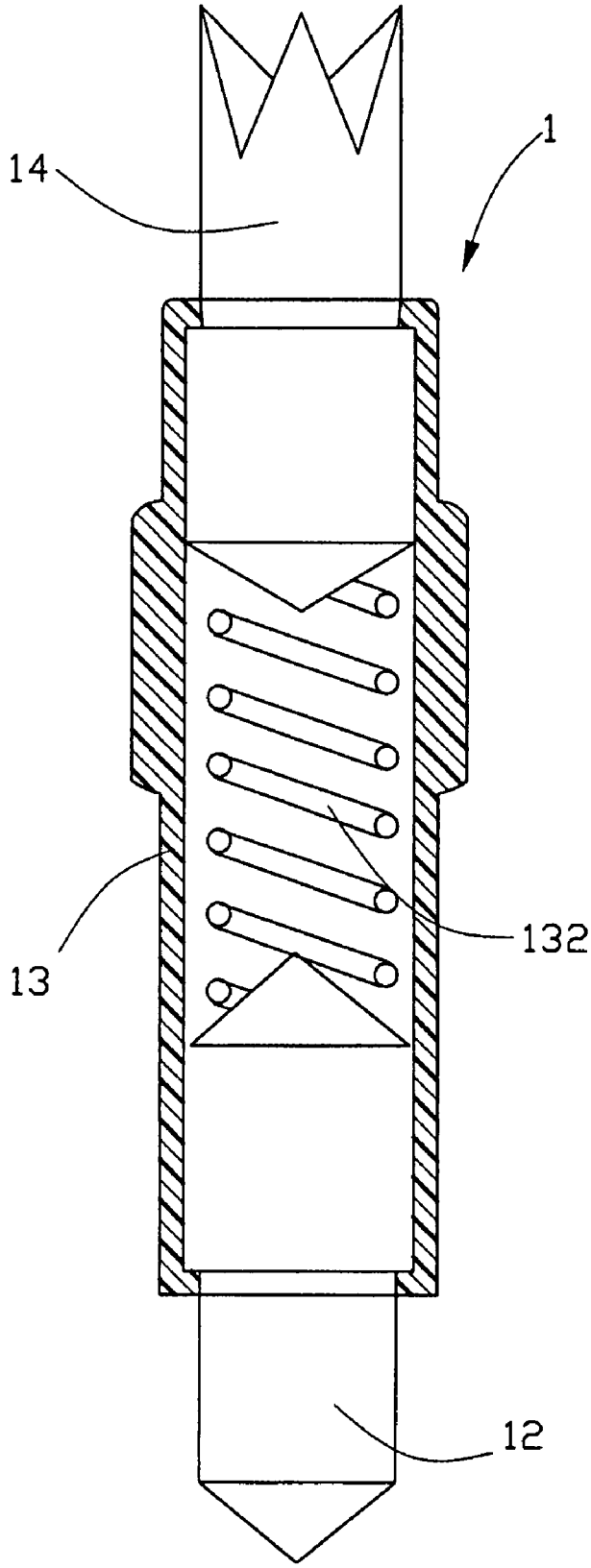
FIG. 2 is a cross sectional view of the whole terminal of FIG. 1.

Referring to FIGS. 1 to 2, an electrical connector, often applicable in a test process, is shown according to a first embodiment of the present invention. The electrical connector includes an insulative housing 2 defining an interior or mating side 21 adapted to face a mating component, such as an LGA package (not shown), an exterior or mounting side 23 adapted to face a substrate (not shown), an opening 25 extending from the mating side 21 towards the mounting side 23, and a substantially elongated movable contact or terminal 1 insertable into the opening 25 of the insulative housing 2.

As shown in FIG. 2, the terminal 1 includes a middle portion 13 for being retained within the opening 25 of the insulative housing 2 and defining a receptacle for accommodating a spring element 132 therein, an upper contact or engaging end 14 and a lower contact end 12 elastically attached to opposite sides of the middle portion 13, i.e. the ends of the spring element 132 of the middle portion 13, so as to enable either the upper contact end 14 or the lower contact end 12 longitudinally movable relative to the opening 25 of the insulative housing 2. However, in other embodiments, merely the lower contact end 12 of the terminal 1 is elastically attached to the middle portion 13, and longitudinally movable relative to the insulative housing 2, while the upper contact end 14 of the terminal 1 is fixably attached to the middle portion The lower movable contact end 12 is configured to extend substantially to the exterior or mounting side 23 of the insulative housing 2 so as to electrically connect to the substrate, while the upper contact end 14 is adapted to mate with the mating component. A body of reflowable, electrically conductive material 5, such as in a form of a solder ball, is disposed on the lower movable contact end 12 adjacent the exterior side 23 of the insulative housing 2. However, in other embodiments, the body of reflowable, electrically conductive material may take on any suitable form other than the solder ball as known in the prior art. The body of conductive material is heat fused to the lower contact end 12 of the terminal 1 so that the lower contact end 12 resides within the body of conductive material 5. In this embodiment, the lower contact end 12 of the terminal 1 has a triangular shape, from a side view thereof. However, in other embodiment, the lower contact end 12 of the terminal 1 may have any other suitable shape in order to effectively extend into the body of conductive material 5. As such, the electrical connector is assembled onto the substrate by the formation of the bodies of conductive material 5 between the terminals 1 of the electrical connector and the substrate, thereby having no openings or holes defined on the substrate and taking no damage to a wiring or connection layout on the substrate.

Figure 3:
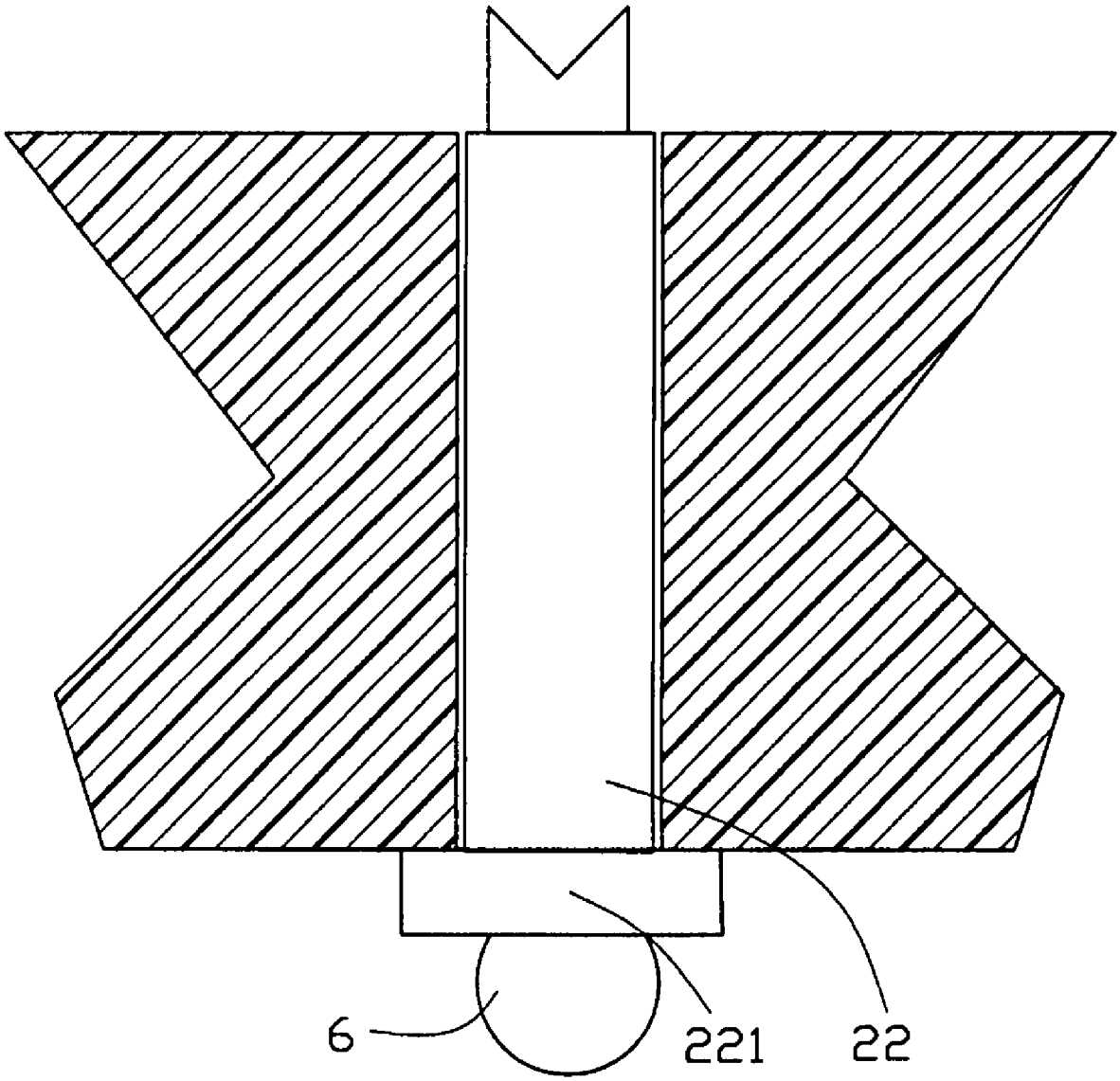
FIG. 3 is a sketch view of a part of an electrical connector according to a second embodiment of the present invention, showing a distal end of a terminal including a planar bottom surface for engaging a body of conductive material.

Referring to FIG. 3, an electrical connector is shown according to a second embodiment of the present invention. The electrical connector is similar to that of the electrical connector of the first embodiment, except for the lower contact end 22. The lower contact end 22 includes a planar bottom surface 221 for an electrically conductive heat fusible element 6, often in a form of a solder ball, to be engaged thereon.

Figure 4:
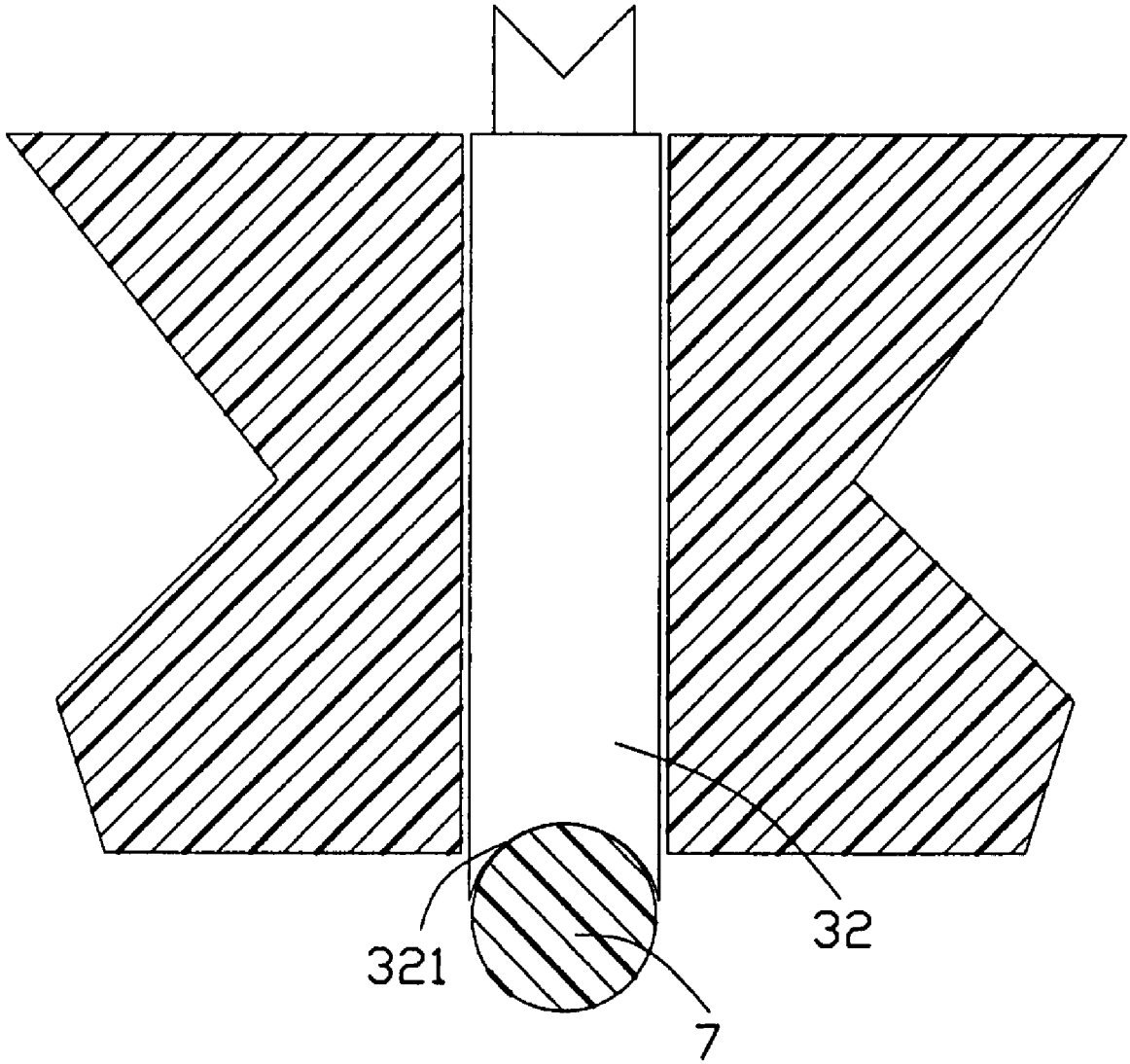
FIG. 4 is a sketch view of a part of an electrical connector according to a third embodiment of the present invention, showing a distal end of a terminal including a substantially spherical surface for engaging a body of conductive material.
Figure 5:
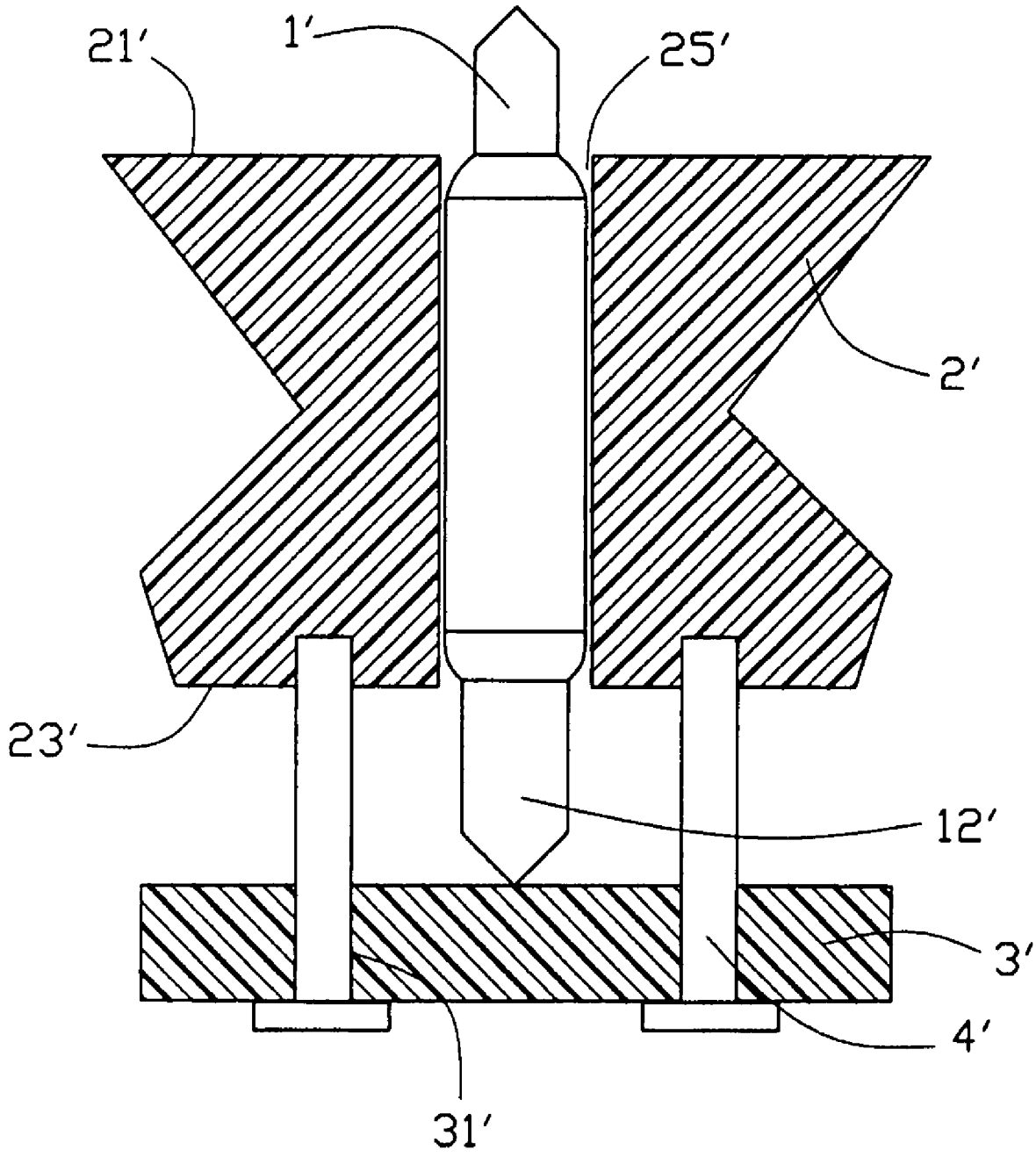
FIG. 5 (PRIOR ART)
FIG. 5 is a sketch view of a part of a conventional electrical connector assembly, showing the connection between an electrical connector and a substrate by pressing a movable contact end of a terminal against the substrate.
Figure 6:
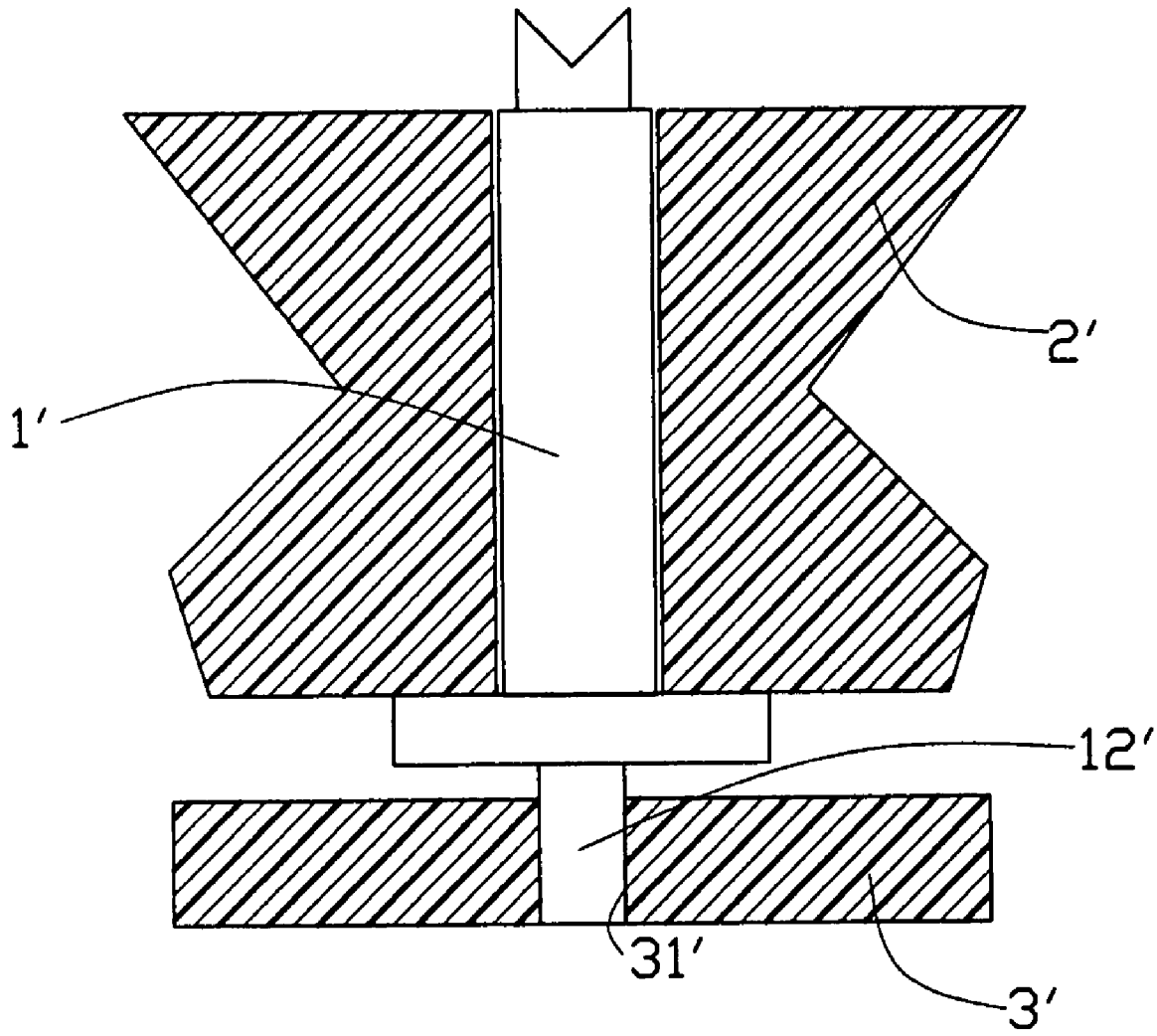
FIG. 6 (PRIOR ART)
FIG. 6 is a sketch view of a part of another conventional electrical connector, showing the connection between an electrical connector and a substrate by holding a contact end of a terminal within a hole of the substrate.

Referring to FIG. 4, an electrical connector is shown according to a third embodiment of the present invention. The electrical connector is similar to that of the electrical connector of the first embodiment, except for the lower contact end. The lower contact end 32 includes a substantially spherical surface 321 for an electrically conductive heat fusible element 7, often in a form of a solder ball, to be engaged thereon so as to have the spherical surface 321 of the lower contact end 32 in compliance with an outer surface of the solder ball 7. It should be noted that, the contact end 32 might include other suitable regular or irregular surface for engaging the electrically conductive heat fusible element 7 depending on different applications. Thus, since the electrical connector is assembled onto a substrate (not shown) by the formation of the electrically conductive heat fusible element 7 between terminals of the electrical connector and the substrate, no openings or holes have been defined on the substrate, thereby doing no damage to a wiring or connection layout on the substrate.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector adapted to be mounted on a substrate, the electrical connector comprising:

an insulative housing, the insulative housing having an exterior side adapted to face the substrate, and passageways extending through the housing;

a substantially elongated terminal resided within each passageway, said terminal adapted to mate wit a mating component and extending substantially to the exterior side of the insulative housing, the terminal having a movable contact end longitudinally movable relative to the insulative housing, the movable contact end defining an enlarged segment adjacent the exterior side of the housing, said enlarged segment in width being larger than that of the passageway; and a body of reflowable, electrically conductive material attached onto said enlarged segment;

wherein the terminal further includes a middle section having a spring element received therein, said contact end compressed by the spring element so as to have the contact end elastically movable with respect to the middle section of the terminal; and wherein the enlarged segment defines a planar bottom surface for the body of conductive material to be engaged thereon, said planar bottom surface in width being larger than that of any one of the body of conductive material and the passageway.

2. The electrical connector as recited in claim 1, wherein the body of conductive material is in a form of a solder ball.

* * * * *